US009076603B2

(12) United States Patent
Senzaki

(10) Patent No.: US 9,076,603 B2
(45) Date of Patent: Jul. 7, 2015

(54) SWITCH PACKING AND ELECTRONIC KEY USING THE SAME

(75) Inventor: Daisuke Senzaki, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 36 days.

(21) Appl. No.: 13/523,215

(22) Filed: Jun. 14, 2012

(65) Prior Publication Data

US 2013/0015048 A1 Jan. 17, 2013

(30) Foreign Application Priority Data

Jul. 13, 2011 (JP) ..... 2011-154578

(51) Int. Cl.
*H01H 13/06* (2006.01)
*H01H 9/02* (2006.01)
*H01H 9/04* (2006.01)

(52) U.S. Cl.
CPC ..... *H01H 9/0235* (2013.01); *H01H 9/041* (2013.01); *H01H 13/063* (2013.01)

(58) Field of Classification Search
USPC ..... 200/302.1, 302.2, 295
IPC ..... H01H 9/04,13/06
See application file for complete search history.

(56) References Cited

U.S. PATENT DOCUMENTS

| | | | | |
|---|---|---|---|---|
| 7,046,136 | B2 * | 5/2006 | Sugimoto et al. | 340/539.1 |
| 2004/0085251 | A1 | 5/2004 | Shimura | |
| 2004/0253867 | A1 | 12/2004 | Matsumoto | |

FOREIGN PATENT DOCUMENTS

| | | | |
|---|---|---|---|
| JP | 02-210726 | A | 8/1990 |
| JP | 2003-157740 | A | 5/2003 |
| JP | 2004-150184 | A | 5/2004 |

OTHER PUBLICATIONS

Japanese Application No. 2011-154578 Office Action dated Jul. 15, 2014 and partial English translation.

* cited by examiner

*Primary Examiner* — Vanessa Girardi
(74) *Attorney, Agent, or Firm* — Roberts Mlotkowski Safran & Cole P.C.

(57) ABSTRACT

A switch packing includes a switch mechanism part disposed between an operation button and a switch element, and configured to be elastically deformed by pushing the operation button so as to have the switch element change to a first state and provide an operational feeling via the operation button, and a sealing part configured to prevent penetration of a liquid. The switch mechanism part and the sealing part are integrated with each other.

9 Claims, 8 Drawing Sheets

80b BOTTOM SURFACE
80c SIDE SURFACE PART
90c SIDE SURFACE PART
900 SEALING PART

912 UPPER PART 913 CONVEX PORTION
914 CONVEX PORTION 916 UPPER SURFACE
917 SIDE PART

417 CONVEX PORTION 418 CONTACT SURFACE

SWITCH PACKING AND ELECTRONIC KEY USING THE SAME

The present application is based on Japanese patent application No. 2011-154578 filed on Jul. 13, 2011, the entire contents of which are incorporated herein by reference.

BACKGROUND OF THE INVENTION

1. Field of the Invention

This invention relates to a switch packing (i.e., a packing for a switch) and an electronic key using the switch packing.

2. Description of the Related Art

An actuator is known that is disposed between a push-button and a switch element, and comprised of an elastic member that allows the switch element to be electrically opened or closed by an elastic deformation of the elastic member (e.g., refer to JP-A-H02-210726). The actuator is continuously formed by an extrusion processing.

As the actuator has a cross section uniform in the depth direction, the actuator can be cut into predetermined lengths along the depth direction so as to produce plural actuators.

SUMMARY OF THE INVENTION

In equipping plural switches, the conventional actuator needs to be provided for each of the switches. However, since the actuator does not have a waterproof structure, a member other than the actuator is needed so as to provide the switches with waterproofness. Therefore, the manufacturing cost will increase.

Therefore, it is an object of the invention to provide a switch packing that is configured to easily change the operational feeling of a switch and to provide the switch with waterproofness, as well as an electronic key using the switch packing.

(1) According to one embodiment of the invention, a switch packing comprises:

a switch mechanism part disposed between an operation button and a switch element, and configured to be elastically deformed by pushing the operation button so as to have the switch element change to a first state and provide an operational feeling via the operation button; and a sealing part to prevent penetration of a liquid, wherein the switch mechanism part and the sealing part are integrated with each other.

In the above embodiment (1) of the invention, the following modifications and changes can be made.

(i) The switch mechanism part comprises:

a cylindrical part having a cylindrical shape and projecting from a top surface of the switch packing;

a plurality of convex portions formed on an upper surface of the cylindrical part and operable to contact with the operation button; and a dome part having a domical shape, formed in an opening of the cylindrical part, and operable to contact with the operation button at an upper surface thereof and to contact with the switch element at a surface opposite to the upper surface.

(ii) The sealing part is formed outwardly projecting from a bottom part of a side surface part formed along a contour of the top surface in which the switch mechanism part is formed.

(iii) The switch packing further comprises:

a lid portion configured to cover substantially an entirety of a substrate on which the switch element is mounted, wherein the lid portion comprises a top surface in which the switch mechanism part is formed, and wherein the lid portion is integrated with the switch mechanism part and the sealing part.

(iv) The sealing part prevents the penetration of the liquid by being sandwiched by an upper case and a lower case that enclose the substrate in a vertical direction.

(v) The upper case comprises a smaller surface area than the lower case such that the upper case is fitted in the lower case.

(vi) The switch packing further comprises a silicone resin.

(vii) The switch mechanism part comprises a plurality of switch mechanism parts.

(viii) The switch packing further comprises a switch packing for an electronic key.

(2) According to another embodiment of the invention, an electronic key comprises a transmitter module including the switch packing according to the above embodiment (1).

Points of the Invention

According to one embodiment of the invention, a switch packing is constructed such that the lid portion configured to cover substantially an entirety of a substrate on which the switch element is integrated with the switch mechanism part and the sealing part, where the lid portion is comprised of a top surface (90*a*) and a side surface part (90*c*) (See FIG. 4B). Therefore, the electronic switch can have the waterproofness by using the switch packing.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Summary of Embodiment

The switch packing according to the embodiment includes a switch mechanism part disposed between an operation button and a switch element, and configured to be elastically deformed due to a push-down operation of the operation button, so as to allow the switch element to be placed in a first state and simultaneously provide an operational feeling via the operation button, and a sealing part configured to prevent penetration of liquid, wherein the switch mechanism part and the sealing part are integrally formed with each other.

Embodiment

Configuration of Electronic Key 1

Figure 1A:
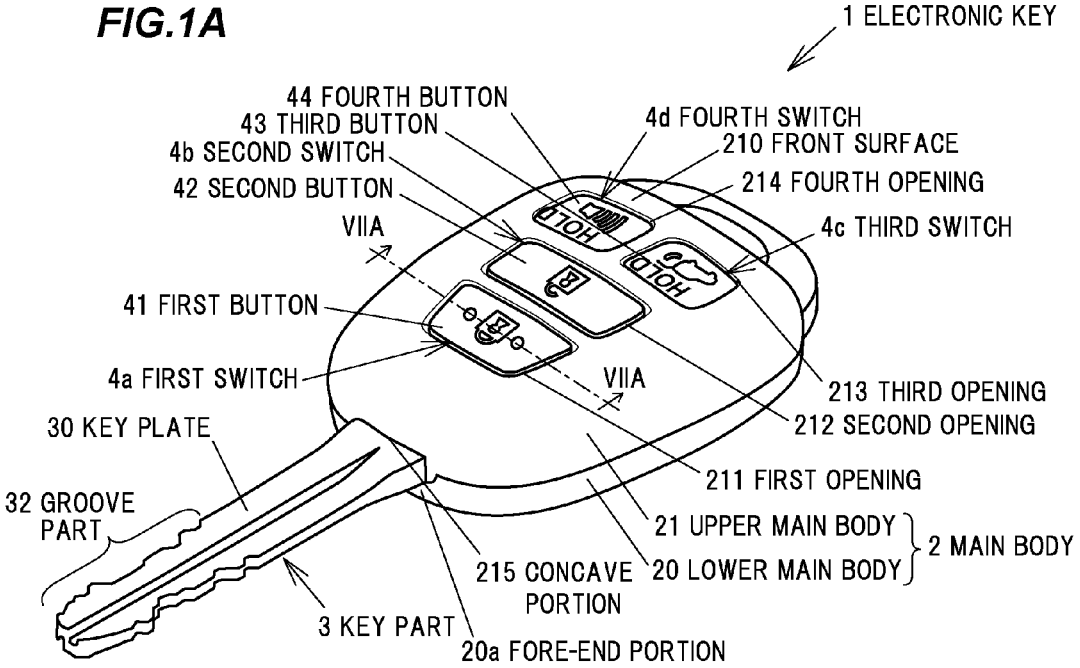
FIG. 1A is a perspective view schematically showing an electronic key using a switch packing according to an embodiment of the invention.
Figure 1B:
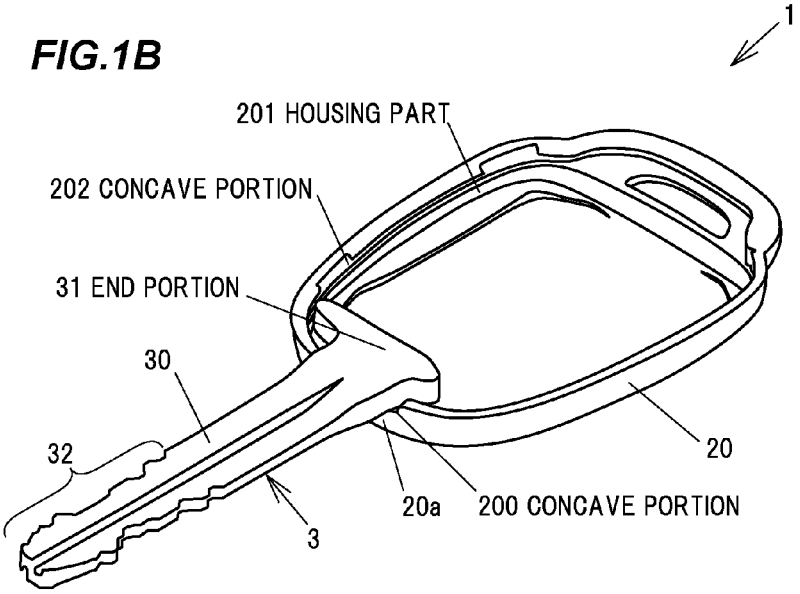
FIG. 1B is a perspective view showing a state that an upper main body is removed from the electronic key shown in FIG. 1A.
Figure 2A:
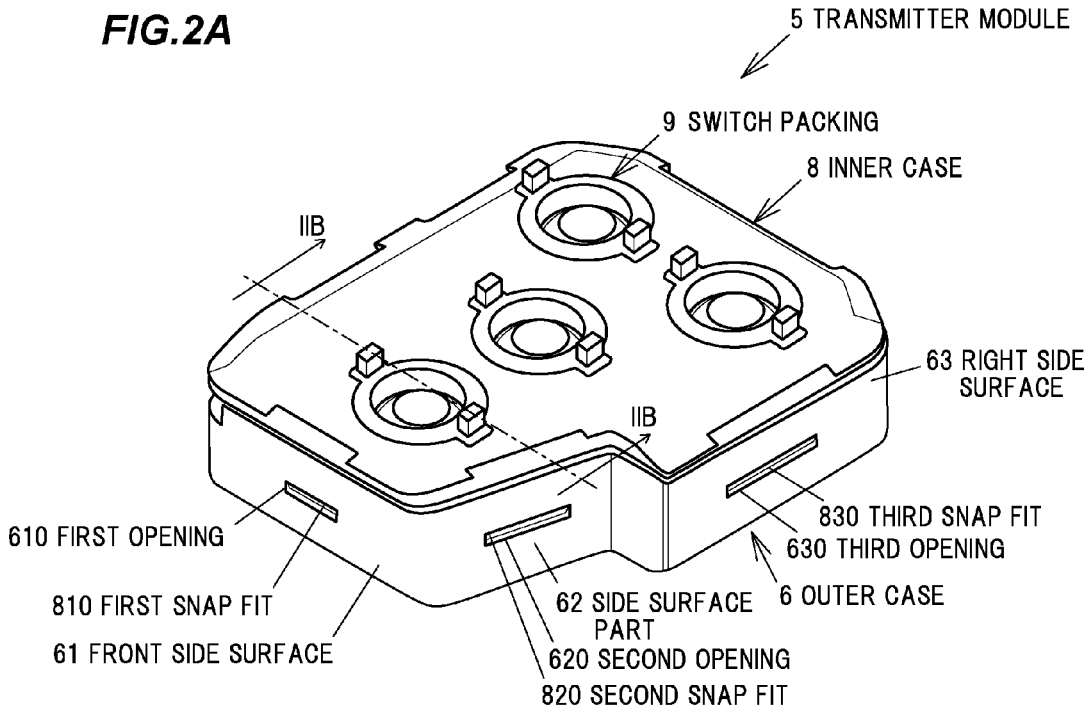
FIG. 2A is a perspective view schematically showing a transmitter module of the electronic key according to the embodiment of the invention.
Figure 2B:
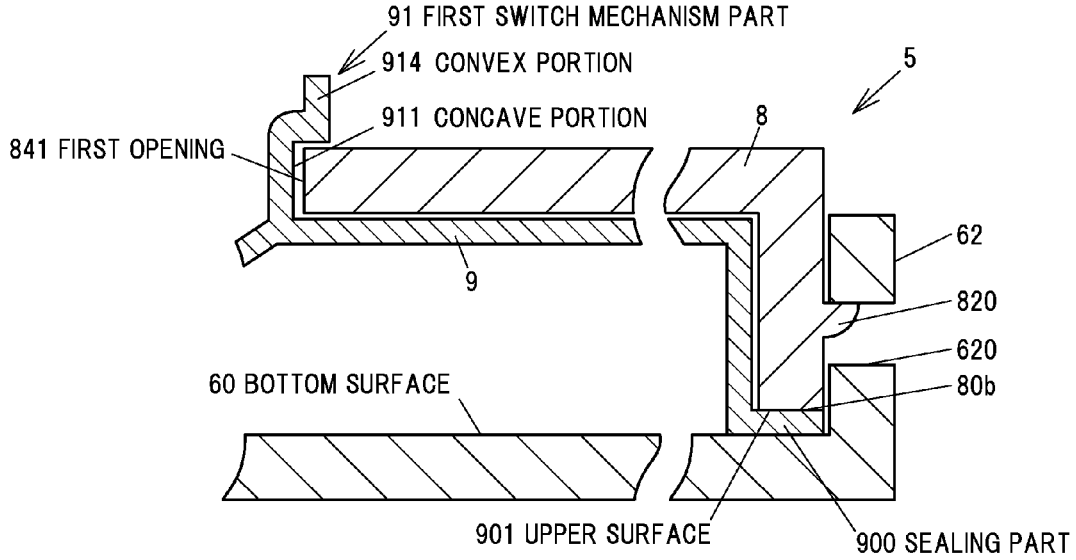
FIG. 2B is a cross-sectional view taken along the line II(b)-II(b) in FIG. 2A and viewed along the direction of an arrow, for explaining a waterproof function of the switch packing.

FIG. 1A is a perspective view schematically showing an electronic key using a switch packing according to an embodiment of the invention, and FIG. 1B is a perspective view showing a state that an upper main body is removed from the electronic key shown in FIG. 1A. FIG. 2A is a perspective view schematically showing a transmitter module of the electronic key according to the embodiment of the invention and FIG. 2B is a cross-sectional view taken along the line II(b)-II(b) in FIG. 2A and viewed along the direction of an arrow, for explaining a waterproof function of the switch packing. Further, in each of the drawings according to the embodiment, a proportion of one component to another component may be different from the actual proportion. In addition, unless it is explicitly stated otherwise, hereinafter, it will be described as "upper" in the case of a side of the upper main body 21, "lower" in the case of a side of the lower main body 20, "front" in the case of a side of the front-end portion 20*a*, "rear" in the case of an opposite side to the front-end portion 20*a*, "right" in the case of a right hand of the front-end portion 20*a* and "left" in the case of a left hand of the front-end portion 20*a*.

The electronic key 1 is capable of locking or unlocking, for example, a door, a trunk or the like of vehicles by remote control. The electronic key 1 is roughly configured to include, for example, the main body 2, the key part 3, the first switch 4*a* to the fourth switch 4*d*, and the transmitter module 5.

Configuration of Main Body 2

As shown in FIG. 1A, for example, the main body 2 is configured such that the whole has a rounded shape, the front-end portion 20*a* to which the key part 3 is attached is formed to be tapered, and an end portion opposite to the front-end portion 20*a* is formed to be wider than the front-end portion 20*a*, thereby the main body 2 has a shape that fits comfortably in one's hand. The main body 2 is formed by using, for example, a synthetic resin material such as a polystyrene based resin, a polyethylene based resin, a polyamide based resin, acrylonitrile/butadiene/styrene (ABS).

As shown in FIGS. 1A and 1B, for example, the main body 2 is comprised of the lower main body 20 and the upper main body 21. The upper main body 21 is configured, for example, such that the upper main body 21 is overlapped with the lower main body 20 and a projection (not shown) of the upper main body 21 is fitted into the concave portion 202 of the lower main body 20, thereby the lower main body 20 and the upper main body 21 are integrally formed.

As shown in FIG. 1B, for example, the lower main body 20 is configured such that a wall is projected from the edge of the bottom surface so as to form a space (housing part 201). In addition, the upper main body 21 is configured such that the same space as the housing part 201 of the lower main body 20 is formed. Hereinafter, a total space of the spaces of the lower main body 20 and the upper main body 21 is referred to as "housing part 201".

The lower main body 20 is configured such that the concave portion 200 is formed in the fore-end portion 20*a*, and the end portion 31 of the key part 3 is fitted into the concave portion 200. In addition, the concave portion 215 is formed in the upper main body 21 corresponding to the concave portion 200, and the end portion 31 that is larger than an opening formed by the concave portion 200 and the concave portion 215 is located internally in the main body 2, thus the key part 3 is configured not to be detached from the main body 2.

In the housing part 201, for example, the transmitter module 5 shown in FIG. 2A is housed.

The upper main body 21 includes, for example, the first opening 211 to the fourth opening 214 in the front surface 210. In the main body 2, for example, the first switch 4*a* to the fourth switch 4*d* are disposed corresponding to these openings 211 to 214. In particular, the first switch 4*a* is disposed in the first opening 211, the second switch 4*b* is disposed in the second opening 212, the third switch 4*c* is disposed in the third opening 213, and the fourth switch 4*d* is disposed in the fourth opening 214.

Configuration of Key Part 3

The key part 3 is configured to include the key plate 30 having a long and thin plate shape. As shown in FIG. 2B, for example, the side of the end portion 31 of the key plate 30 has an almost "T" shape. In addition, the key plate 30 is configured such that the groove part 32 is formed in the side surface thereof. The groove part 32 is formed so as to be different in the shape with respect to each vehicle.

Configuration of Transmitter Module 5

Figure 3:
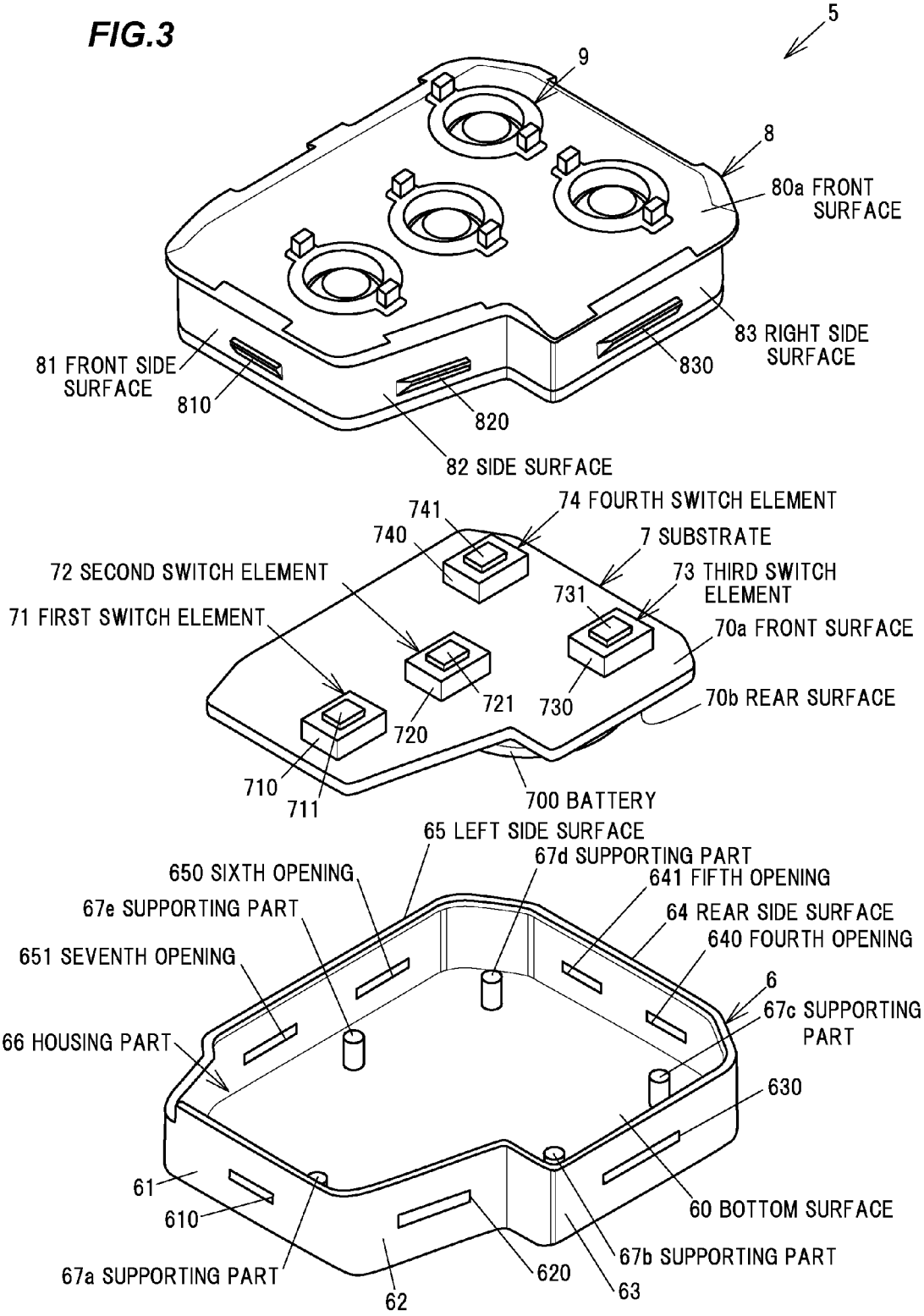
FIG. 3 is an exploded perspective view of the transmitter module used in the embodiment.

FIG. 3 is an exploded perspective view of the transmitter module used in the embodiment.

The transmitter module 5 is, for example, a transmitter that is configured to transmit an operation signal to vehicles via radio waves base on an operation applied to the first switch 4*a* to the fourth switch 4*d*. As shown in FIG. 3, for example, the transmitter module 5 is roughly configured to include the outer case 6, the substrate 7, the inner case 8 and the switch packing 9.

Configuration of Outer Case 6

The outer case 6 is formed by using, for example, a synthetic resin material such as a polystyrene based resin, a polyethylene based resin, a polyamide based resin, acrylonitrile/butadiene/styrene (ABS).

In addition, as shown in FIG. 3, the outer case 6 is configured, for example, such that the bottom surface 60 is formed in a shape that a front portion is narrower than a rear portion in width, and a right portion is interiorly dented. Further, the substrate 7, the front surface 80*a* of the inner case 8 and the top surface 90*a* of the switch packing 9 are respectively configured to have a shape, for example, similar to the bottom surface 60.

The outer case 6 is configured, for example, such that a space (housing part 66) surrounded by side surfaces projecting from edges of the bottom surface 60 is formed. In the bottom surface 60, for example, the supporting parts 67*a* to 67*e* having a columnar shape are disposed. Further, for example, the supporting parts 67*a* to 67*e* can be integrally formed with the outer case 6, but not limited to this, the parts 67*a* to 67*e* can also be attached to the outer case 6 by screw, adhesive or the like.

The supporting parts 67*a* to 67*e* are disposed in order to support the substrate 7, and are arranged in accordance with the external form of the substrate 7.

In addition, a plurality of openings into which snap fits formed in the side surfaces of the inner case 8 are fitted, are formed in the side surfaces of the outer case 6. As shown in FIGS. 2A and 3, the outer case 6 is configured, for example, such that the first opening 610 is formed in the front side surface 61, the second opening 620 is formed in the side surface 62 that is dented and located at the right side of the front side surface 61, the third opening 630 is formed in the right side surface 63, the fourth opening 640 and the fifth opening 641 are formed in the rear side surface 64, and the sixth opening 650 and the seventh opening 651 are formed in the left side surface 65.

Configuration of Substrate 7

The substrate 7 is, for example, a circuit substrate configured to mount various electronic components. The substrate 7 is configured, for example, such that the first to fourth switch elements 71 to 74 are arranged in the front surface 70*a*. In addition, as shown in FIG. 3, the battery 700 is attached to the rear surface 70*b* of the substrate 7. In addition, for example, the substrate 7 is configured to be housed in a space located at the side of the rear surface 90*b* of the switch packing 9, and is configured such that the first to fourth front-end portions 711 to 741 of the first to the fourth switch elements 71 to 74 are in contact with the switch packing 9.

The first to the fourth switch elements 71 to 74 are respectively, for example, a switch such as a tact switch configured such that it is switched on (set in a first state) when the first to fourth front-end portions 711 to 741 are pushed-down so as to be moved within the respective main bodies 710, 720, 730 and 740, and it is switched off when the first to fourth front-end portions 711 to 741 are returned to the former state thereof. The first to the fourth switch elements 71 to 74 are, for example, respectively disposed corresponding to the first to the fourth buttons 41 to 44.

Configuration of Inner Case 8

Figure 4A:
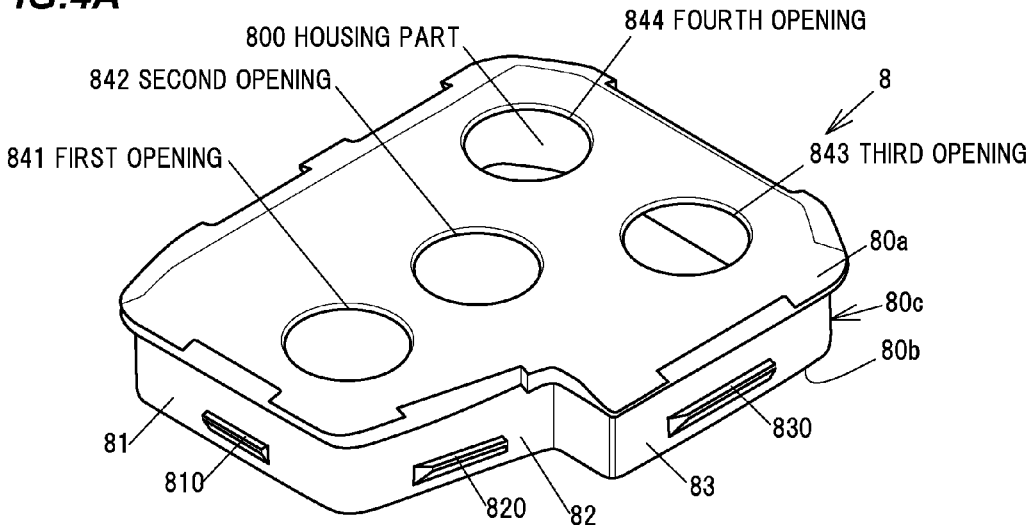
FIG. 4A is a perspective view schematically showing an inner case used in the embodiment.
Figure 4B:
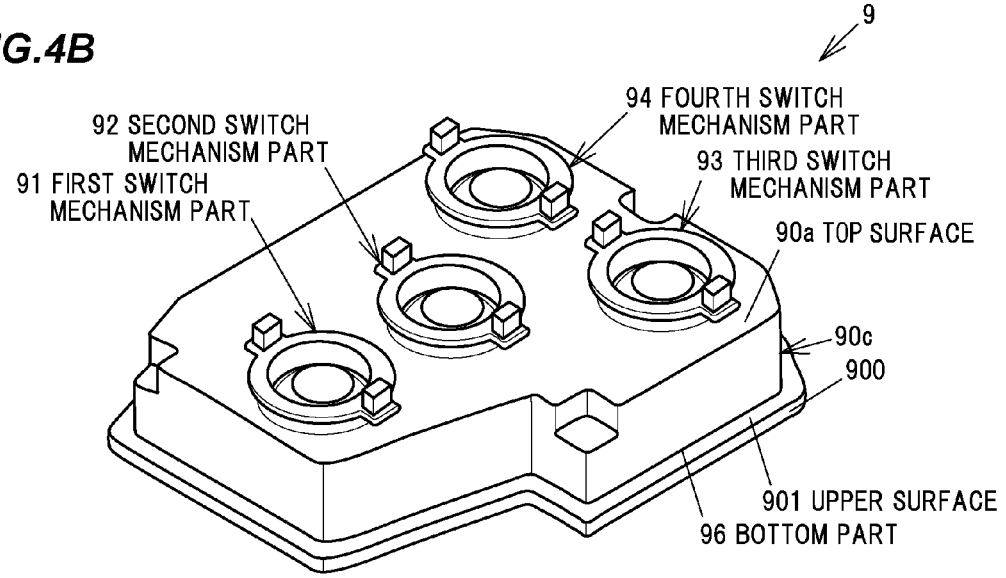
FIG. 4B is a perspective view schematically showing the switch packing according to the embodiment.

FIG. 4A is a perspective view schematically showing an inner case used in the embodiment, and FIG. 4B is a perspective view schematically showing the switch packing according to the embodiment.

The inner case 8 is formed by using, for example, a synthetic resin material such as a polystyrene based resin, a polyethylene based resin, a polyamide based resin, acrylonitrile/butadiene/styrene (ABS). In the front surface 80*a* of the inner case 8, for example, the first to the fourth circular openings 841 to 844 are formed correspondingly to the respective first to the fourth switches 4*a* to 4*d*.

As shown in FIG. 4A, the inner case 8 is configured, for example, such that the side surface part 80*c* is formed along the edge of the front surface 80*a*, and the first snap fit 810 is formed in the front side surface 81. In addition, as shown in FIG. 4A, the second snap fit 820 is formed in the side surface 82 that is dented and located at the right side of the front side surface 81, and the third snap fit 830 is formed in the right side surface 83. Further, snap fits (not shown) are formed in the rear side surface and the left side surface correspondingly to the fourth to the seventh openings 640 to 651 of the outer case 6.

The first snap fit 810 has, for example, a long and thin shape along the edge of the front surface 80*a*, and the upper surface thereof has a planar shape approximately parallel to the front surface 80*a*. In addition, the first snap fit 810 is configured, for example, such that a cross sectional surface obtained when the first snap fit 810 is cut by a plane parallel to the front surface 80*a* becomes reduced in size in proportion to lowness of the location (refer to FIG. 2B). The second snap fit 820, the third snap fit 830 and the other snap fits are respectively formed so as to have a shape, for example, similar to the first snap fit 810.

Configuration of Switch Packing 9

Figure 5A:
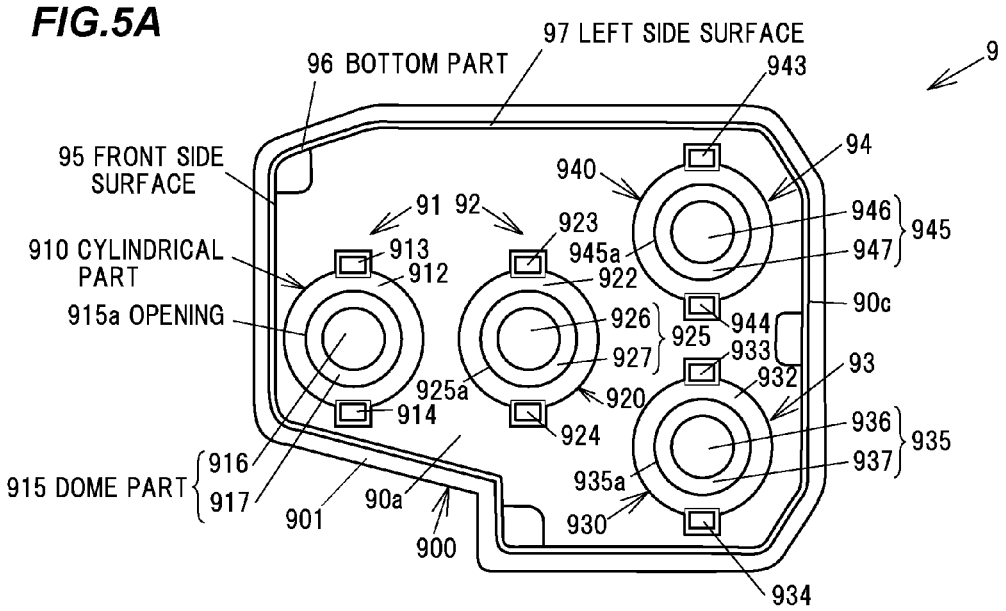
FIG. 5A is a top view schematically showing the switch packing according to the embodiment.
Figure 5B:
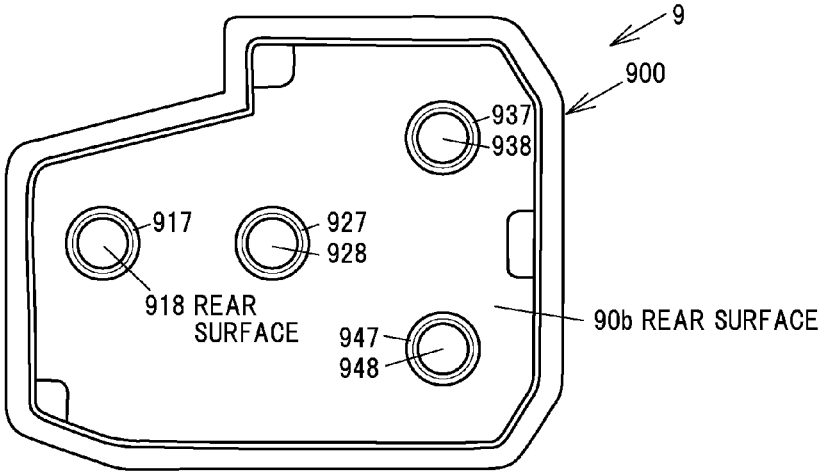
FIG. 5B is a bottom view schematically showing the switch packing according to the embodiment.
Figure 5C:
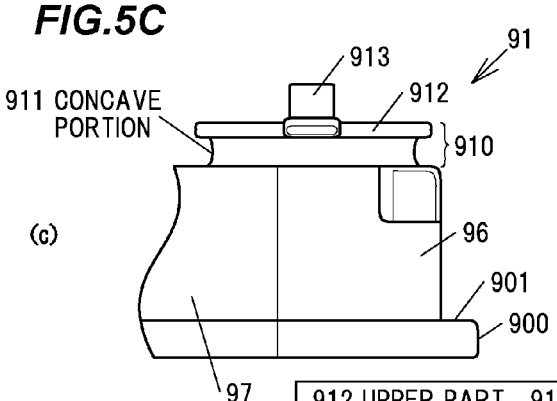
FIG. 5C is a left side view schematically showing the switch packing according to the embodiment.
Figure 5D:
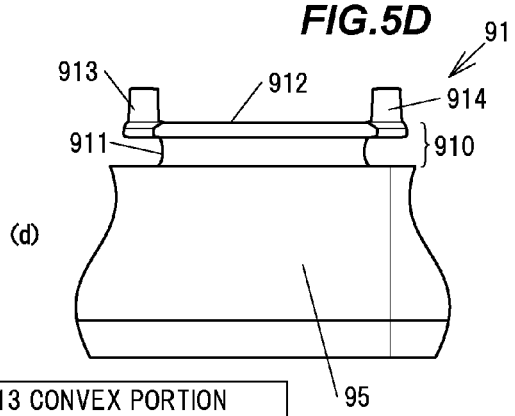
FIG. 5D is a front side view schematically showing the switch packing according to the embodiment.

FIG. 5A is a top view, FIG. 5B is a bottom view, FIG. 5C is a left side view, and FIG. 5D is a front side view schematically showing the switch packing according to the embodiment. FIG. 5C is a drawing in case that the first switch mechanism part 91 is viewed from the side of the left side surface 97. FIG. 5D is a drawing in case that the first switch mechanism part 91 is viewed from the side of the front side surface 95.

The switch packing 9 is formed of, for example, a silicone resin such as a silicone rubber. The switch packing 9 has, for example, a shape fitted to the shape (i.e., internal shape) of the housing part 800 of the inner case 8.

As shown in FIG. 4B, in the top surface 90*a* of the switch packing 9, for example, the first to the fourth switch mechanism parts 91 to 94 are formed.

The first switch mechanism part 91 is disposed, for example, between the first button 41 and the first switch element 71, and configured to be elastically deformed due to a push-down operation of the first button 41, so as to allow the first switch element 71 to be switched on and simultaneously provide an operational feeling with an operator via the first button 41.

The second switch mechanism part 92 is disposed, for example, between the second button 42 and the second switch element 72, and configured to be elastically deformed due to a push-down operation of the second button 42, so as to allow the second switch element 72 to be switched on and simultaneously provide an operational feeling with an operator via the second button 42.

The third switch mechanism part 93 is disposed, for example, between the third button 43 and the third switch element 73, and configured to be elastically deformed due to a push-down operation of the third button 43, so as to allow the third switch element 73 to be switched on and simultaneously provide an operational feeling with an operator via the third button 43.

The fourth switch mechanism part 94 is disposed, for example, between the fourth button 44 and the fourth switch element 74, and configured to be elastically deformed due to a push-down operation of the fourth button 44, so as to allow the fourth switch element 74 to be switched on and simultaneously provide an operational feeling with an operator via the fourth button 44.

As shown in FIGS. 5A to 5D, the first switch mechanism part 91 is roughly configured to include, for example, the cylindrical part 910 having a cylindrical shape, and projecting from the top surface 90*a*, the convex portions 913, 914 formed on the upper part 912 of the cylindrical part 910, and being in contact with the first button 41, and the dome part 915 having a domical shape and formed in the opening 915*a* of the cylindrical part 910, of which upper surface 916 is in contact with the first button 41 and the rear surface 918 opposite to the upper surface 916 is in contact with the first switch element 71. The upper part 912 is formed, for example, so as to have a circular shape larger than that of the first opening 841.

As shown in FIG. 5C, the cylindrical part 910 is configured, for example, to have the concave portion 911 formed such that the side surface has a dented shape. The concave portion 911 is configured to, for example, be fitted into the first opening 841.

As shown in FIG. 5D, in the upper part 912, for example, the convex portions 913, 914 are formed so as to project from the upper part 912 and face to each other. The convex portions 913, 914 have, for example, a plate shape respectively.

The second switch mechanism part 92 is roughly configured to include, for example, the cylindrical part 920, the convex portions 923, 924 formed on the upper part 922 of the cylindrical part 920, and being in contact with the second button 42, and the dome part 925 having a domical shape and formed in the opening 925*a* of the cylindrical part 920, of which upper surface 926 is in contact with the second button 42 and the rear surface 928 opposite to the upper surface 926 is in contact with the second switch element 72. The upper part 922 is formed, for example, so as to have a circular shape larger than that of the second opening 842.

The cylindrical part 920 is configured, for example, to have a concave portion (not shown) formed so as to have the same shape as that of the concave portion 911. The concave portion is configured to, for example, be fitted into the second opening 842.

In the upper part 922, for example, the convex portions 923, 924 are formed so as to project from the upper part 922 and face to each other. The convex portions 923, 924 have, for example, a plate shape respectively.

The third switch mechanism part 93 is roughly configured to include, for example, the cylindrical part 930, the convex portions 933, 934 formed on the upper part 932 of the cylindrical part 930, and being in contact with the third button 43, and the dome part 935 formed in the opening 935*a* of the cylindrical part 930, of which upper surface 936 is in contact with the third button 43 and the rear surface 938 opposite to the upper surface 936 is in contact with the third switch element 73. The upper part 932 is formed, for example, so as to have a circular shape larger than that of the third opening 843.

The cylindrical part 930 is configured, for example, to have a concave portion (not shown) formed so as to have the same shape as that of the concave portion 911. The concave portion is configured to, for example, be fitted into the third opening 843.

In the upper part 932, for example, the convex portions 933, 934 are formed so as to project from the upper part 932 and face to each other. The convex portions 933, 934 have, for example, a plate shape respectively.

The fourth switch mechanism part 94 is roughly configured to include, for example, the cylindrical part 940, the convex portions 943, 944 formed on the upper part 942 of the cylindrical part 940, and being in contact with the fourth button 44, and the dome part 945 formed in the opening 945*a* of the cylindrical part 940, of which upper surface 946 is in contact with the fourth button 44 and the rear surface 948 opposite to the upper surface 946 is in contact with the fourth switch element 74. The upper part 942 is formed, for example, so as to have a circular shape larger than that of the fourth opening 844.

The cylindrical part 940 is configured, for example, to have a concave portion (not shown) formed so as to have the same shape as that of the concave portion 911. The concave portion is configured to, for example, be fitted into the fourth opening 844.

In the upper part 942, for example, the convex portions 943, 944 are formed so as to project from the upper part 942 and face to each other. The convex portions 943, 944 have, for example, a plate shape respectively.

Configuration of First to Fourth Switches 4*a* to 4*d*

Figure 6A:
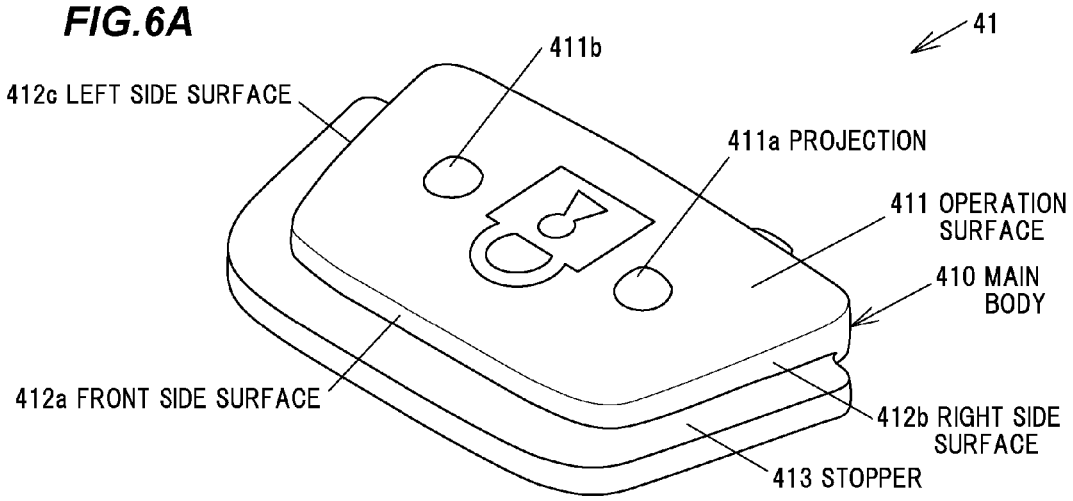
FIG. 6A is a perspective view schematically showing a first button of the electronic key according to the embodiment.
Figure 6B:
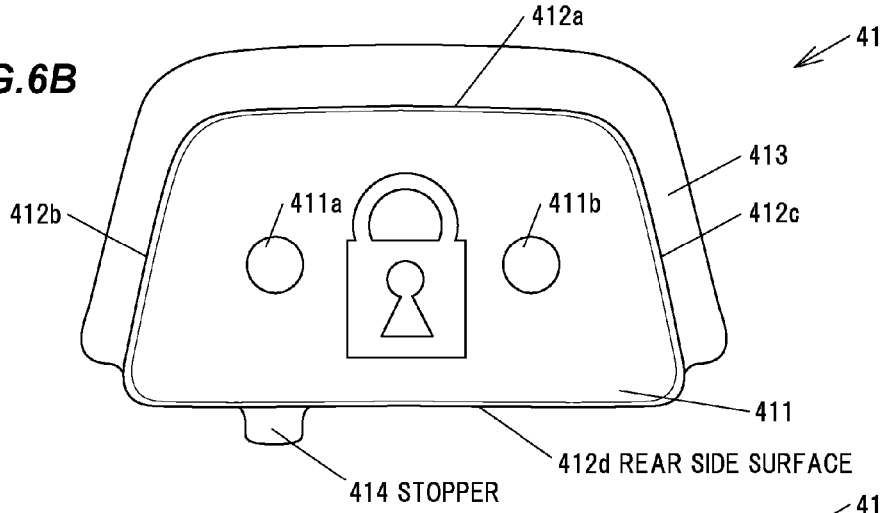
FIG. 6B is a top view schematically showing the first button of the electronic key according to the embodiment.
Figure 6C:
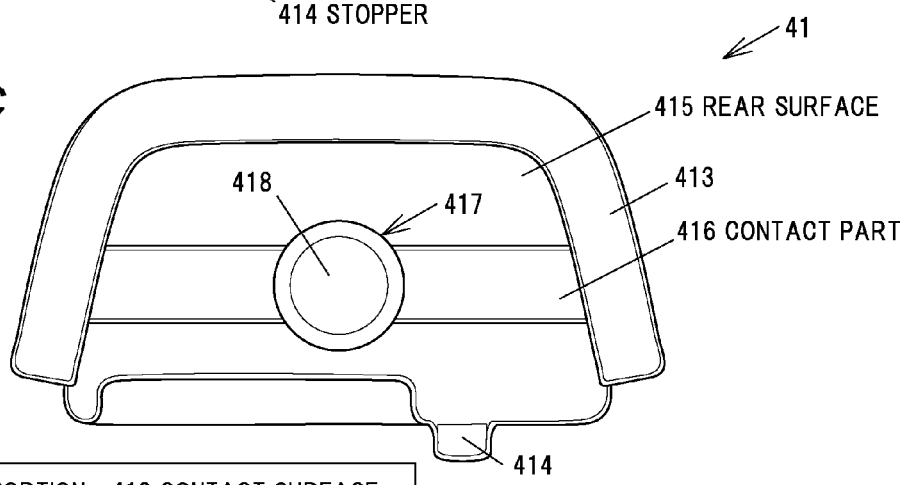
FIG. 6C is a bottom view schematically showing the first button of the electronic key according to the embodiment.

FIG. 6A is a perspective view, FIG. 6B is a top view and FIG. 6C is a bottom view schematically showing a first button of the electronic key according to the embodiment.

The electronic key 1 includes, for example, the first to fourth switches 4*a* to 4*d*. The first switch 4*a* is, for example, a switch configured to lock a door of vehicles. The second switch 4*b* is, for example, a switch configured to unlock a door of vehicles. The third switch 4*c* is, for example, a switch configured to unlock a trunk of vehicles by being continuously pushed down for a predetermined time. The fourth switch 4*d* is, for example, a switch configured to output a warning alarm by being continuously pushed down.

The first switch 4*a* is roughly configured to include, for example, the first button 41 as an operation button, the first switch mechanism part 91 and the first switch element 71. The second switch 4*b* is roughly configured to include, for example, the second button 42, the second switch mechanism part 92 and the second switch element 72. The third switch 4*c* is roughly configured to include, for example, the third button 43, the third switch mechanism part 93 and the third switch element 73. The fourth switch 4*d* is roughly configured to include, for example, the fourth button 44, the fourth switch mechanism part 94 and the fourth switch element 74.

Subsequently, hereinafter, in order to explain an operation of the first switch 4*a* described below, a configuration of the first button 41 will be mainly explained.

As shown in FIGS. 6A to 6C, the first button 41 is configured to have the stopper 413 that functions to prevent the first button 41 from being detached from the opening the upper main body 21 upper main body 21, and that is formed along the front side surface 412*a*, the right side surface 412*b* and the left side surface 412*c* of the operation surface 411. The stopper 413 has, for example, a plate shape that projects along the front side surface 412*a*, the right side surface 412*b* and the left side surface 412*c*.

In addition, in the rear side surface 412*d* of the first button 41, for example, the stopper 414 having a plate shape that projects from the rear side surface 412*d* and functions to prevent the first button 41 from being detached from the opening of the upper main body 21. In the operation surface 411, for example, the projections 411*a* and 411*b* having a conical shape are formed.

In the center of the rear surface 415 of the first button 41, for example, the convex portion 417 that projects from rear surface 415 and has a conical shape is formed. The convex portion 417 is configured, for example, such that the contact surface 418 is formed in the upper part. The contact surface 418 is in contact with the upper surface 916 of the dome part 915 of the first switch mechanism part 91. In addition, the contact surface 416 is formed from the central portion to the right side surface 412*b* and the left side surface 412*c*. The contact surface 416, for example, has a rectangular shape and is in contact with the convex portions 913 and 914 of the first switch mechanism part 91. Further, the second to the fourth buttons 42 to 44 are configured to be approximately similar to the first button 41, thus detail explanation will be omitted.

Waterproof Property of Transmitter Module 5

In the switch packing 9, for example, the sealing part 900 configured to prevent penetration of liquid is formed. The sealing part 900 is formed so as to project exteriorly from the bottom part 96 of the side surface part 90*c* formed along the contour of the top surface 90*a*.

As shown in FIG. 2B, in case of being assembled as the transmitter module 5, the sealing part 900 is sandwiched between the bottom surface 60 of the outer case 6 and the bottom surface 80*b* of the inner case 8 so as to be elastically deformed.

When the inner case 8 to which the switch packing 9 is attached is assembled with the outer case 6 to which the substrate 7 is attached, at the stage that the sealing part 900 is in contact with the bottom surface 60 of the outer case 6 and the bottom surface 80*b* of the inner case 8 (at the stage that the sealing part 900 is not elastically deformed), all of the snap fits of the inner case 8 are not fitted into the openings formed in the side surfaces of the outer case 6. In order that the snap fits are fitted into the openings, it is needed for the sealing part 900 to be elastically deformed. Due to the elastic deformation of the sealing part 900, for example, as shown in FIG. 2B, good waterproof property can be obtained even if there is a gap between the inner case 8 and the switch packing 9.

Hereinafter, the operation of the first switch 4*a* of the electronic key 1 will be explained. Further, the operation of the second to the fourth switches 4*b* to 4*d* is almost similar to that of the first switch 4*a* except for signals output, thus the explanation will be omitted.

Operation of First Switch 4*a*

Figure 7A:
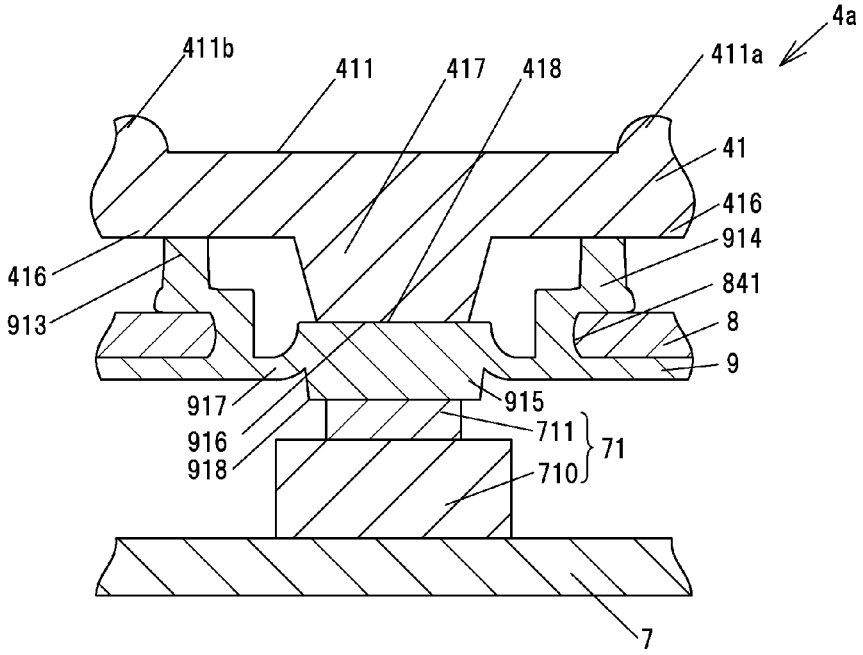
FIGS. 7A and 7B are cross-sectional views taken along the line VII(a)-VII(a) in FIG. 1A and viewed along the direction of an arrow, for explaining an operation of the first switch part used in the embodiment.
Figure 7B:
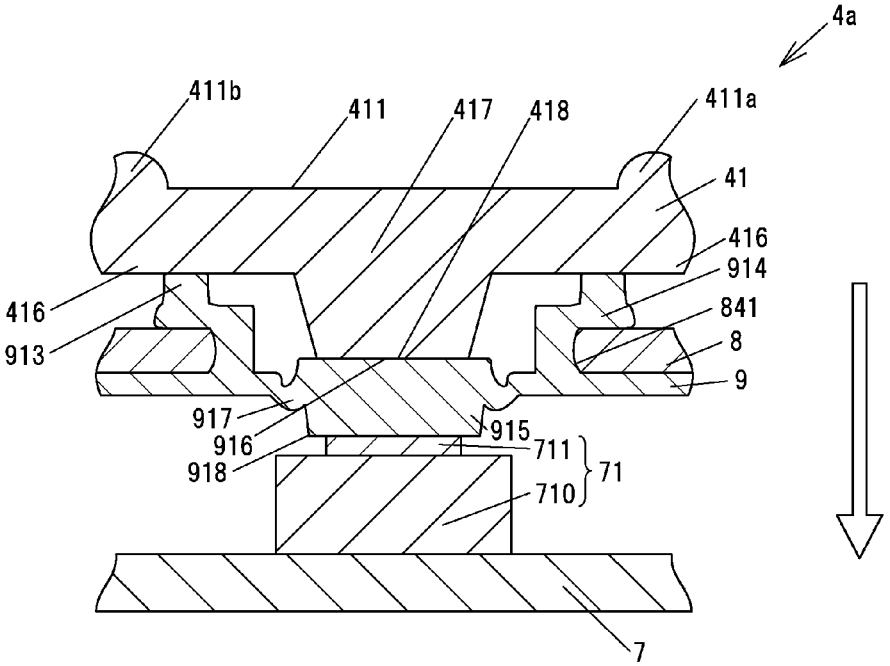

FIGS. 7A and 7B are cross-sectional views taken along the line VII(a)-VII(a) in FIG. 1A and viewed along the direction of an arrow, for explaining an operation of the first switch part used in the embodiment. FIG. 7A shows a state before an operation is carried out, and FIG. 7B shows a state after the operation has been carried out.

As shown in FIG. 7A, for example, the first switch 4*a* before the operation is configured such that the convex portions 913, 914 are in contact with the contact surface 416 of the first button 41, the upper surface 916 of the dome part 915 is in contact with the contact surface 418 of the first button 41, and the rear surface 918 of the dome part 915 is in contact with the front-end portion 711 of the first switch element 71.

When the first button 41 is pushed down in the direction of an arrow shown in FIG. 7B, for example, as shown in FIG. 7B, due to the displacement of the first button 41, the convex portions 913, 914 are elastically deformed, and simultaneously the side part 917 of the dome part 915 is elastically deformed so as to push the front-end portion 711 of the first switch element 71 into the main body 710.

The first switch element 71 is switched on by that the front-end portion 711 is pushed into the main body 710, a signal showing "ON" is output from the electronic key 1 wirelessly via an electronic circuit of the substrate 7. A vehicle that has received the signal, for example, locks a door of the vehicle.

When an operator takes his (her) finger off the first button 41, the first button 41 is returned to a state before the operation by elastic forces to go back to the former state, of the convex portions 913, 914 and the side part 917 that are elastically deformed.

Subsequently, hereinafter, an assembly of the inner case 8 and the switch packing 9 will be explained.

Assembly of the Switch Packing 9 and the Inner Case 8

Figure 8A:
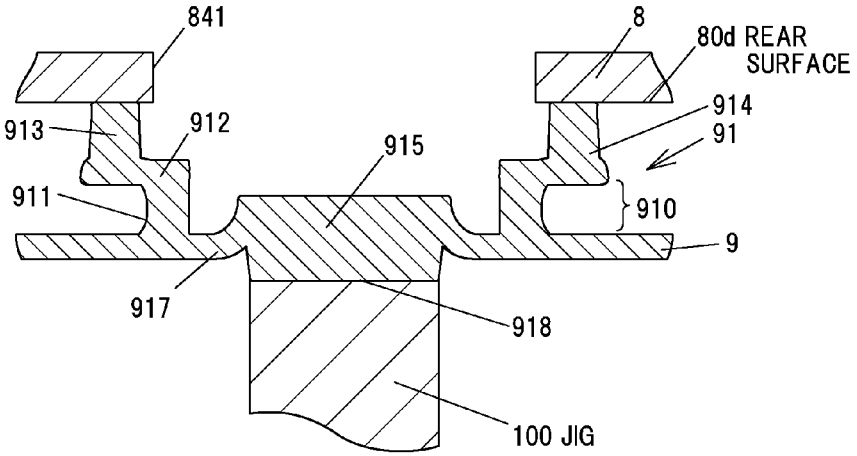
FIGS. 8A to 8C are cross-sectional views of the primary portion for explaining an assembly of the switch packing according to the embodiment and an inner case.
Figure 8B:
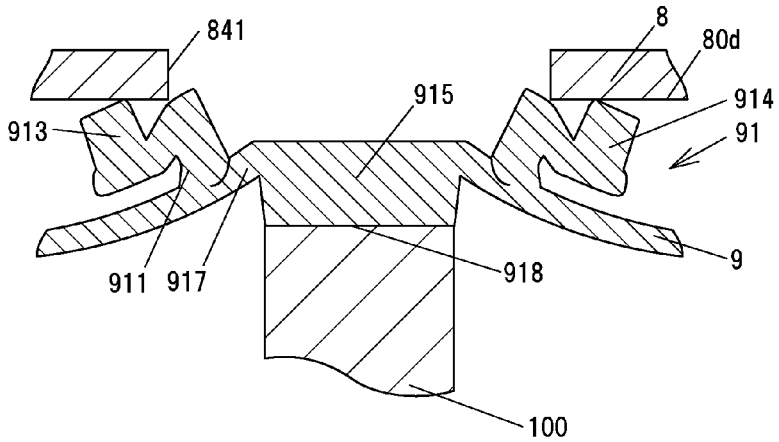
Figure 8C:
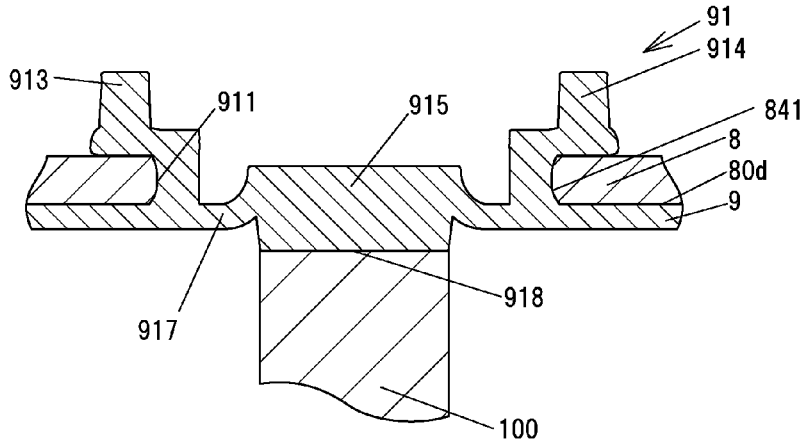

FIGS. 8A to 8C are cross-sectional views of the primary portion for explaining an assembly of the switch packing according to the embodiment and an inner case. For example, a method of assembling the switch packing 9 in a state shown in FIG. 4B and the inner case 8 in a state shown in FIG. 4A will be explained.

First, as shown in FIG. 8A, the convex portions 913, 914 of the switch packing 9 are brought into contact with the rear surface 80*d* of the first opening 841 of the inner case 8 corresponding to the first switch mechanism part 91, and the jig 100 is brought into contact with the rear surface 918 of the first switch mechanism part 91.

Next, as shown in FIG. 8B, the jig 100, the switch packing 9 and the inner case 8 are relatively moved in the direction of pushing the first switch mechanism part 91 into the first opening 841. For example, due to the relative movement, mainly, the upper part 912, the convex portion 913, the convex portion 914 and the side part 917 of the dome part 915 are elastically deformed.

Next, as shown in FIG. 8C, when the relative movement is further continued, the upper part 912, the convex portion 913, and the convex portion 914 are exposed on the front surface 80*a* of the inner case 8 via the first opening 841, and the edge of the first opening 841 is fitted into the concave portion 911 of the cylindrical part 910, so that the assembly of the first switch mechanism part 91 is completed.

Subsequently, the above-mentioned assembling operation is applied to each of the other switch mechanism parts, so that the assembly of the switch packing 9 and the inner case 8 is completed.

Further, in the above-mentioned example, a method of carrying out an assembling operation with respect to each of the switch mechanism parts is adopted, but not limited to this, a method of preparing the jigs 100 of which number is corresponding to that of the switch mechanism part, and carrying out the assembling operation at one time can be also adopted. In addition, the switch packing 9 has a high elasticity, thus the assembling operation can be carried out by a finger instead of the jig 100.

Advantages of the Embodiment

The electronic key 1 according to the embodiment is configured such that the switch packing 9 includes the switch mechanism part and the sealing part having a waterproof function that are integrally formed with each other, thus an operational feeling can be easily changed and a waterproof function can be provided. Namely, taking the first switch 4*a* as an example, the operational feeling of the first button 41 can be easily changed mainly by the shapes of the convex portion 913 and the convex portion 914. In case that the switch packing 9 comprised of one type of material, it is formed by using a single mold, thus these changes of the shapes of the convex portions can be easily carried out. However, in case that the switch mechanism part and the sealing part are formed by a two-color molding, it is needed to use a hard resin as the switch mechanism part and use a soft resin like a rubber as the sealing part, and at least two moldings into which materials are poured are required, thus it is not easy to change the shapes of the convex portions.

In addition, the electronic key 1 can be reduced in the production costs in comparison with a case that the switch mechanism part and the sealing part are not integrally formed or are formed by a two-color molding. This is due to the fact that in the former, a member for waterproof as the sealing part is needed separately from the switch mechanism part, and in the latter, two kinds of materials and at least two moldings are needed.

Furthermore, the electronic key 1 according to the embodiment is configured such that the switch packing 9 is comprised of a silicone rubber having a high elasticity as whole, thus it can be easily assembled with the inner case 8 in comparison with a case that the switch mechanism part and the sealing part are not integrally formed or are formed by a two-color molding, so that productivity can be enhanced.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A switch packing, comprising:

a switch mechanism part disposed between an operation button and a switch element, and configured to be elastically deformed by pushing the operation button so as to have the switch element change to a first state and provide an operational feeling via the operation button; and a sealing part to prevent penetration of a liquid, wherein the switch mechanism part and the sealing part are integrated with each other, and wherein the switch mechanism part comprises:

a cylindrical part having a cylindrical shape and projecting from a top surface of the switch packing;

a plurality of convex portions formed on an upper surface of the cylindrical part, and operable to contact with the operation button; and a dome part having a domical shape, formed in an opening of the cylindrical part, and operable to contact with the operation button at an upper surface thereof and to contact with the switch element at a surface opposite to the upper surface.

2. The switch packing according to claim 1, further comprising a switch packing for an electronic key.

3. The switch packing according to claim 1, wherein the sealing part is formed outwardly projecting from a bottom part of a side surface part formed along a contour of the top surface in which the switch mechanism part is formed.

4. An electronic key, comprising a transmitter module including the switch packing according to claim 3.

5. The switch packing according to claim 1, wherein the switch packing is configured to cover substantially an entirety of a substrate on which the switch element is mounted.

6. The switch packing according to claim 5, further comprising a silicone resin.

7. The switch packing according to claim 5, wherein the switch mechanism part comprises a plurality of switch mechanism parts.

8. The switch packing according to claim 5, wherein the sealing part prevents the penetration of the liquid by being sandwiched by an upper case and a lower case that enclose the substrate in a vertical direction.

9. The switch packing according to claim 8, wherein the upper case comprises a smaller surface area than the lower case so as to be fitted in the lower case.

* * * * *